US008115694B2

(12) United States Patent
Lin et al.

(10) Patent No.: US 8,115,694 B2
(45) **Date of Patent: *Feb. 14, 2012**

(54) DUAL-POLARIZED COUPLING DEVICE COMPRISING ANNULAR GROOVE FED BY FIRST AND SECOND FEED CONDUCTORS

(75) Inventors: Yi-Cheng Lin, Taipei (TW); Kuo-Fong Hung, Taipei (TW)

(73) Assignee: National Taiwan University, Taipei (TW)

( * ) Notice: Subject to any disclaimer, the term of this patent is extended or adjusted under 35 U.S.C. 154(b) by 695 days.

This patent is subject to a terminal disclaimer.

(21) Appl. No.: 12/190,559

(22) Filed: Aug. 12, 2008

(65) Prior Publication Data

US 2009/0046027 A1 Feb. 19, 2009

(30) Foreign Application Priority Data

Aug. 13, 2007 (TW) ..... 96129824 A

(51) Int. Cl.
*H01Q 13/22* (2006.01)
*H01P 1/161* (2006.01)

(52) U.S. Cl. ..... 343/769; 343/756; 333/21 A

(58) Field of Classification Search ..... 333/21 A; 343/756, 767, 769, 770
See application file for complete search history.

(56) References Cited

U.S. PATENT DOCUMENTS

| | | | | |
|---|---|---|---|---|
| 3,755,759 | A * | 8/1973 | Cohn | 333/21 R |
| 4,873,529 | A * | 10/1989 | Gibson | 343/700 MS |
| 7,864,125 | B2 * | 1/2011 | Hung et al. | 343/769 |
| 2009/0046027 | A1 * | 2/2009 | Lin et al. | 343/756 |

* cited by examiner

*Primary Examiner* — Benny Lee

(57) ABSTRACT

A coupling device is provided, including a substrate, a ground element, a first feed conductor and a second feed conductor. The substrate includes a first surface and a second surface. The ground element is disposed on the second surface, wherein the ground element includes a first portion, a second portion, an annular groove and a feed slot, the annular groove is located between the first portion and the second portion, enclosing the first portion, and a first end of the feed slot is connected to the annular groove. The first feed conductor is disposed on the first surface corresponding to the annular groove, wherein the first feed conductor couples the ground element to feed a current signal. The second feed conductor is disposed on the first surface corresponding to the feed slot, wherein second feed conductor couples the feed slot to feed a magnetic current.

13 Claims, 8 Drawing Sheets

DUAL-POLARIZED COUPLING DEVICE COMPRISING ANNULAR GROOVE FED BY FIRST AND SECOND FEED CONDUCTORS

BACKGROUND OF THE INVENTION

1. Field of the Invention

The invention relates to a coupling device, and more particularly to a coupling device with improved isolation.

2. Description of the Related Art

FIG. 1 shows a conventional coupling antenna 1 comprising a substrate 10, a ground element 20, a first feed conductor 30 and a second feed conductor 40. The substrate 10 comprises a first surface 11 and a second surface 12. The ground element 20 is disposed on the second surface 12, which comprises a first portion 21, a second portion 22 and an annular groove 23. The annular groove 23 is located between the first portion 21 and the second portion 22 enclosing the first portion 21. The first feed conductor 30 is disposed on the first surface 11 corresponding to the first portion 21 and the annular groove 23. The second feed conductor 40 is disposed on the first surface 11 corresponding to the first portion 21 and the annular groove 23.

When a conventional coupling antenna 1 is utilized for transmitting wireless signal, noise is generated due to poor isolation between the first feed conductor 30 and the second feed conductor 40.

SUMMARY OF THE INVENTION

A detailed description is given in the following embodiments with reference to the accompanying drawings.

A coupling device is provided, comprising a substrate, a ground element, a first feed conductor and a second feed conductor. The substrate comprises a first surface and a second surface. The ground element is disposed on the second surface, wherein the ground element comprises a first portion, a second portion, an annular groove and a feed slot, the annular groove is located between the first portion and the second portion, enclosing the first portion, and a first end of the feed slot is connected to the annular groove. The first feed conductor is disposed on the first surface corresponding to the annular groove, wherein the first feed conductor couples the ground element to feed a current signal. The second feed conductor is disposed on the first surface corresponding to the feed slot, wherein second feed conductor couples the feed slot to feed a magnetic current.

The coupling device of the invention provides improved port isolation and polarization isolation.

BRIEF DESCRIPTION OF THE DRAWINGS

The invention can be more fully understood by reading the subsequent detailed description and examples with references made to the accompanying drawings, wherein.

DETAILED DESCRIPTION OF THE INVENTION

The following description is of the best-contemplated mode of carrying out the invention. This description is made for the purpose of illustrating the general principles of the invention and should not be taken in a limiting sense. The scope of the invention is best determined by reference to the appended claims.

Figure 1:
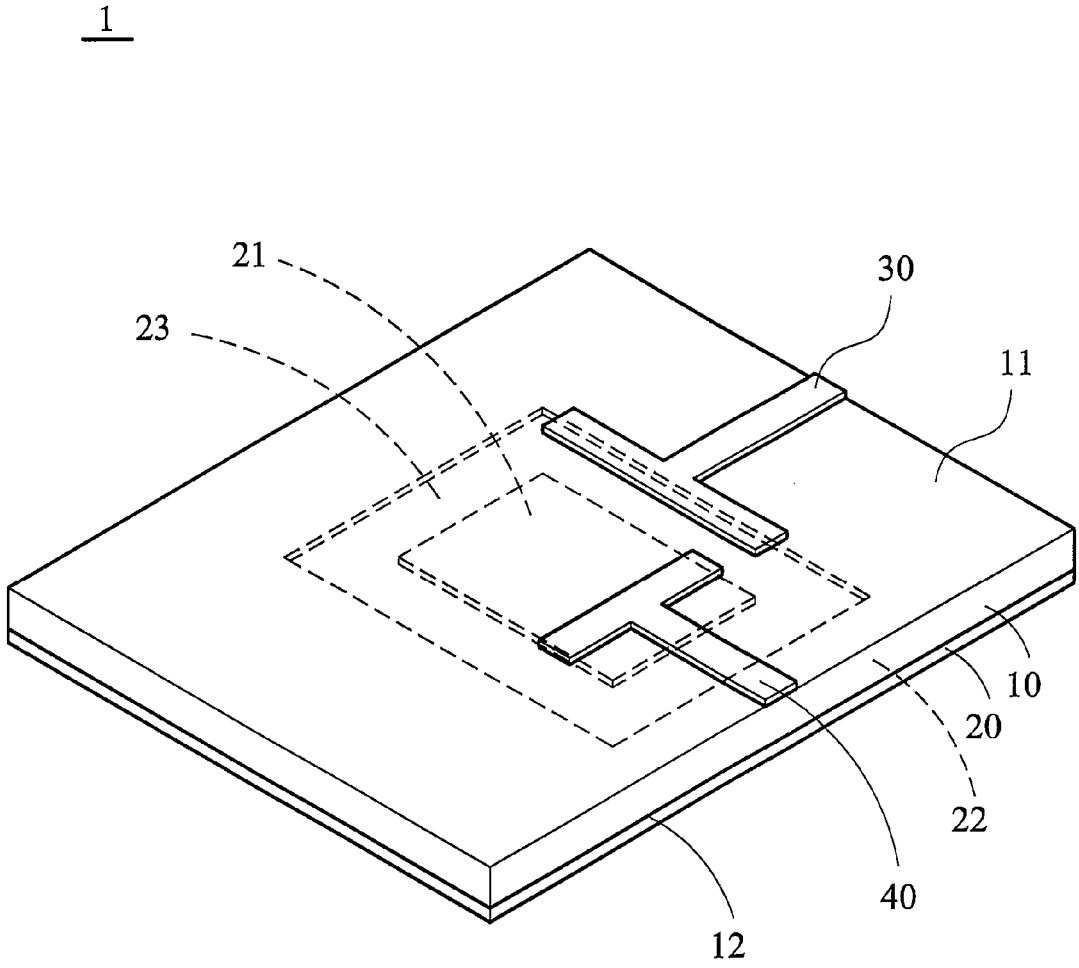
FIG. 1 ( PRIOR ART )
FIG. 1 shows a conventional coupling antenna.
Figure 2:
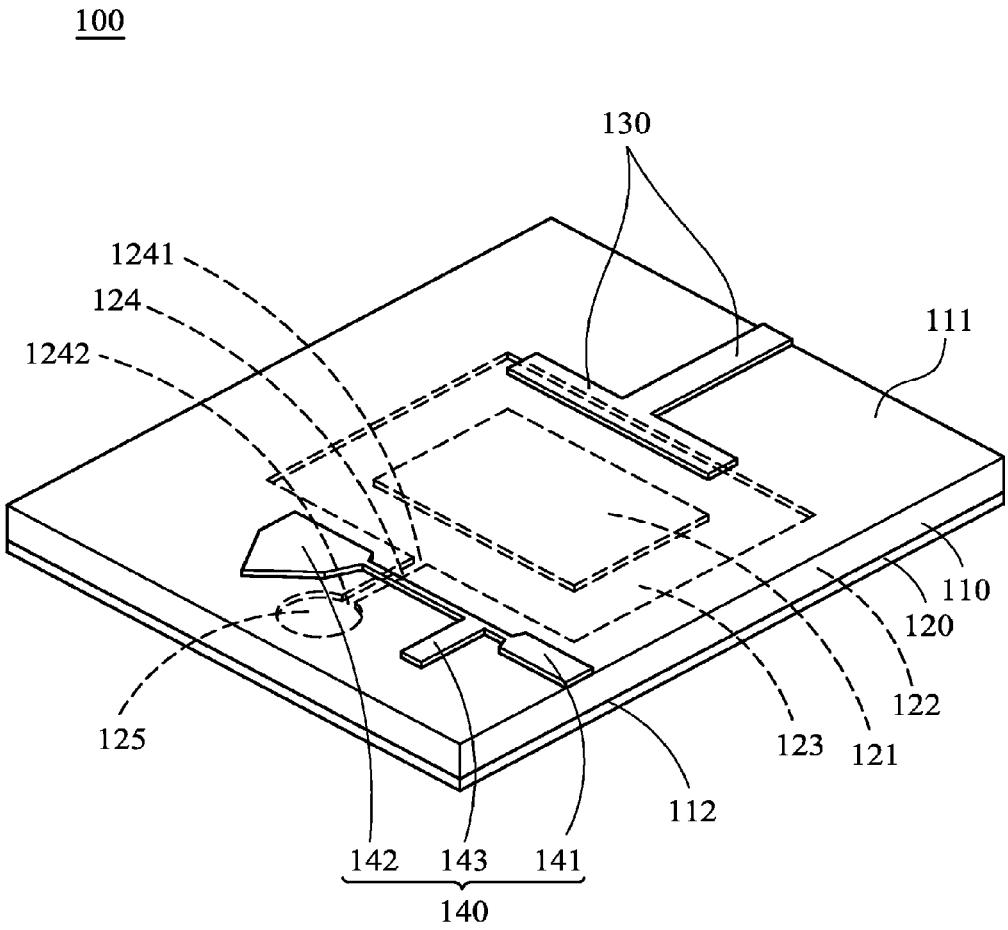
FIG. 2 shows a coupling device of the invention.

FIG. 2 shows a coupling device 100 of the invention which comprises a substrate 110, a ground element 120, a first feed conductor 130 and a second feed conductor 140. The substrate 110 comprises a first surface 111 and a second surface 112. The ground element 120 is disposed on the second surface 112. The first feed conductor 130 and the second feed conductor 140 are disposed on the first surface 111 corresponding to the ground element 120.

The ground element 120 comprises a first portion 121, a second portion 122, an annular groove 123, a feed slot 124 and a short circuit slot 125. The annular groove 123 is located between the first portion 121 and the second portion 122 enclosing the first portion 121. The first portion 121 is rectangular. The annular groove 123 defines a rectangular area. A first end 1241 of the feed slot 124 is connected to the annular groove 123. A second end 1242 of the feed slot 124 is connected to the short circuit slot 125. The short circuit slot 125 is circular.

Figure 3:
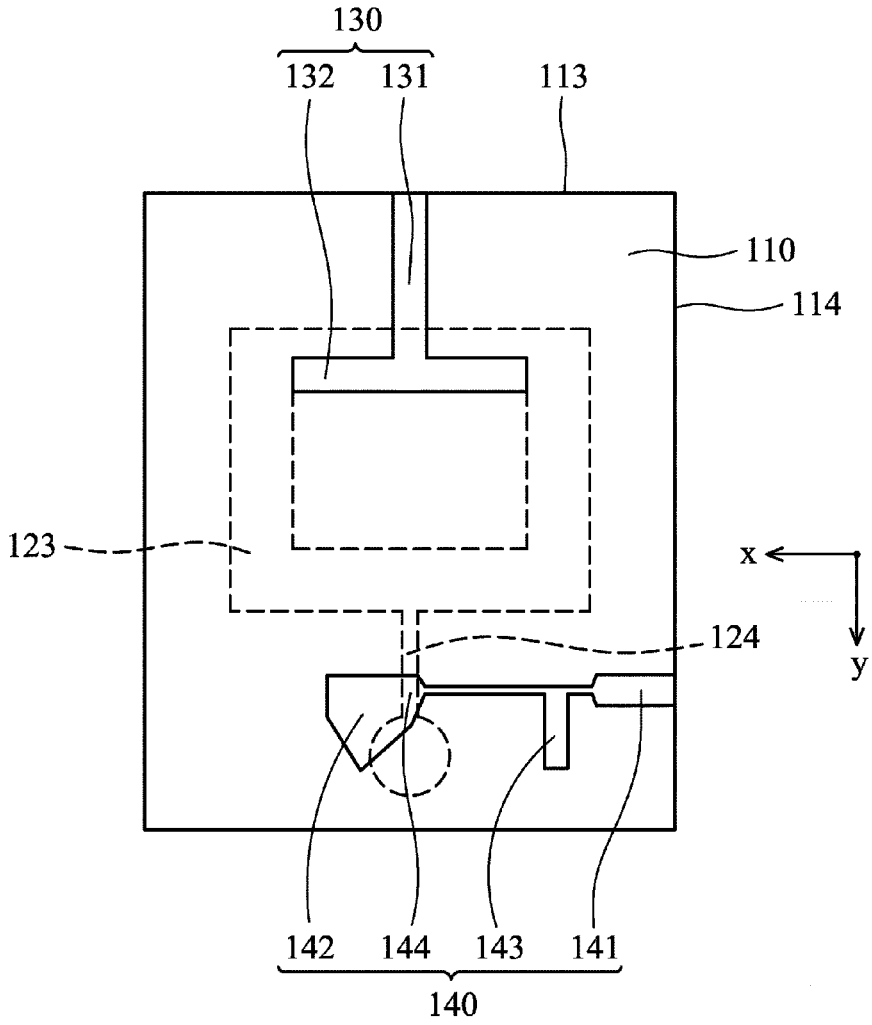
FIG. 3 is a top view of the coupling device of the invention.

With reference to FIG. 3, the substrate 110 further comprises a first side 113 and a second side 114. The first side 113 is perpendicular to the second side 114. The feed conductor 130 extends in a first direction y from the first side 113. The second feed conductor 140 extends in a second direction x from the second side 114. The first direction y is perpendicular to the second direction x.

The first feed conductor 130 is T-shaped, comprising a first conductive portion 131 and a first feed portion 132. The first feed portion 132 corresponds to the annular groove 123. The first conductive portion 131 extends in the first direction y from the first side 113 connected to the first feed portion 132. The first conductive portion 131 is perpendicular to the first feed portion 132.

With reference to FIGS. 2 and 3, the second feed conductor 140 comprises a second conductive portion 141, a second feed portion 142 and a matching element 143. The second feed portion 142 corresponds to the feed slot 124. The second conductive portion 141 extends in the second direction x from the second side 114 connected to the second feed portion 142. The second feed portion 142 is substantially sector-shaped, and comprises a convergent end 144 (FIG. 3). The second conductive portion 141 is connected to the convergent end 144, and the convergent end 144 corresponds to the second end 1242 (FIG. 2) of the feed slot 124. An included angle nearing the convergent end 144 is between 0° to 90°. The matching element 143 connects the second conductive portion 141 and is perpendicular thereto.

Figure 4A:
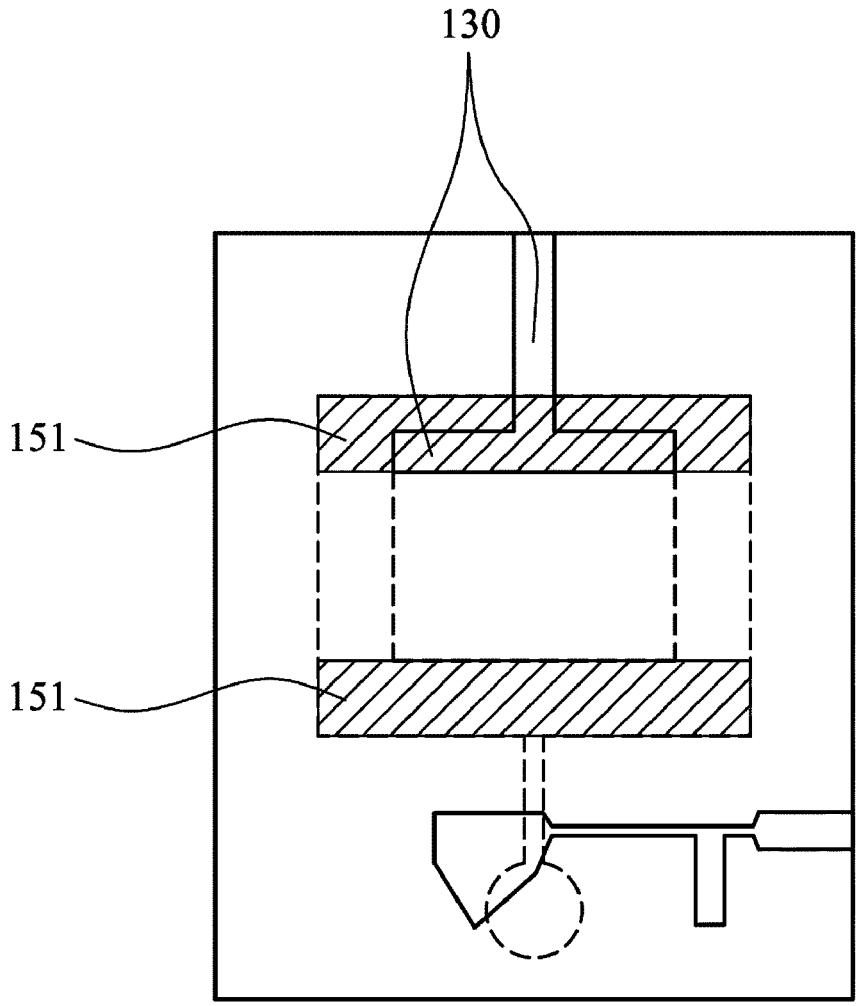
FIG. 4*a* shows location of a first radiation area of the invention.
Figure 4B:
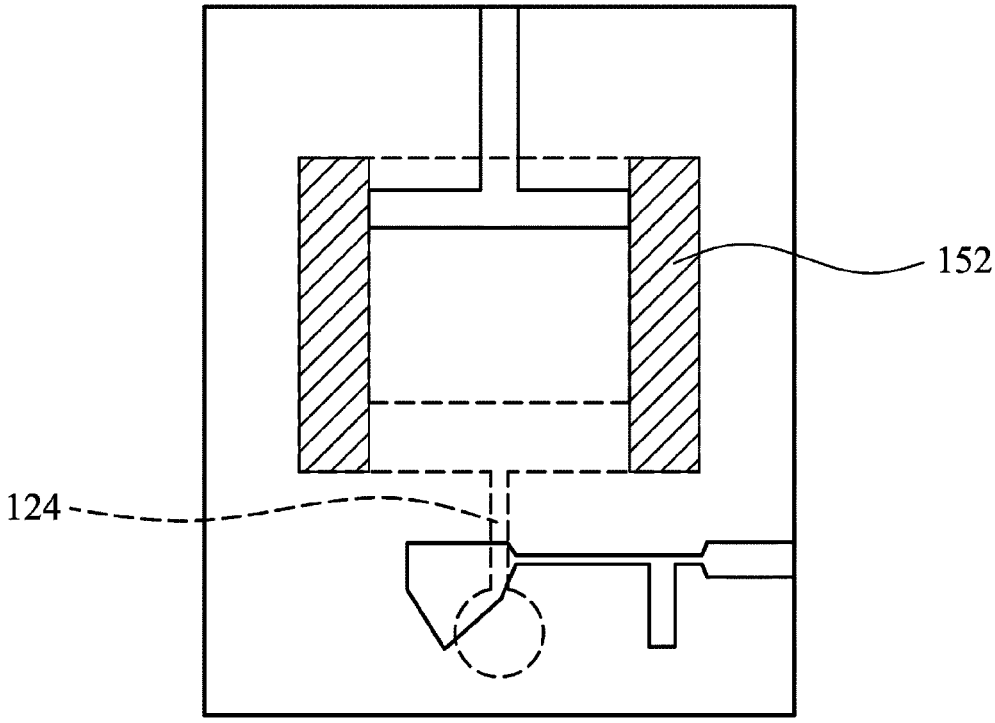
FIG. 4*b* shows location of a second radiation area of the invention.

When the coupling device 100 (FIG. 2) transmits a wireless signal, the first feed conductor 130 couples the ground element 120 (FIG. 2) to feed a current signal, and the second feed conductor 140 couples the feed slot 124 to feed a magnetic current. With reference to FIG. 4*a*, after the first feed conductor 130 couples the ground 120 (FIG. 2) to feed the current signal, the coupling device 100 (FIG. 2) transmits a first wireless signal via a first radiation area 151 (FIG. 4*a*). With reference to FIG. 4*b*, after the second feed conductor 140 couples the feed slot 124 to feed the magnetic current, the coupling device 100 (FIG. 2) transmits a second wireless signal via a second radiation area 152 (FIG. 4*b*). A polarization mode of the first radiation area 151 (FIG. 4*a*) is perpendicular to a polarization mode of the second radiation area 152 (FIG. 4*b*). A polarization direction of the first wireless signal is perpendicular to a polarization direction of the second wireless signal.

Figure 5:
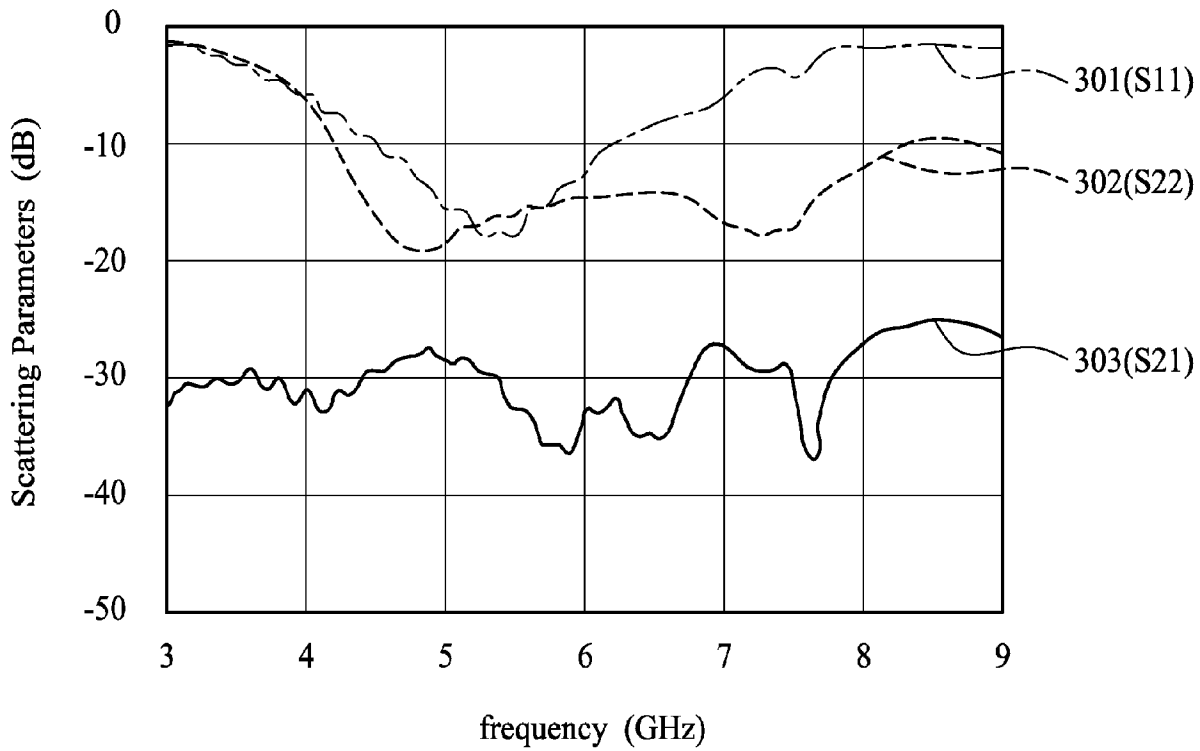
FIG. 5 shows signal reflection of the coupling device of the invention.

FIG. 5 shows signal reflection of the coupling device 100 (FIG. 2) of the invention, wherein curve 301 shows a return loss (S11) of a first output port, curve 302 shows a return loss (S22) of a second output port, and curve 303 shows isolation (S21) between the first output port and the second output port. In FIG. 5, the cross axle represents frequency with unit GHz, and the vertical axle represents Scattering Parameters with unit dB. As shown in FIG. 5, scattering parameter of the curve 303 is substantially lower than −25 dB. The coupling device 100 (FIG. 2) of the invention provides improved port isolation.

Figure 6A:
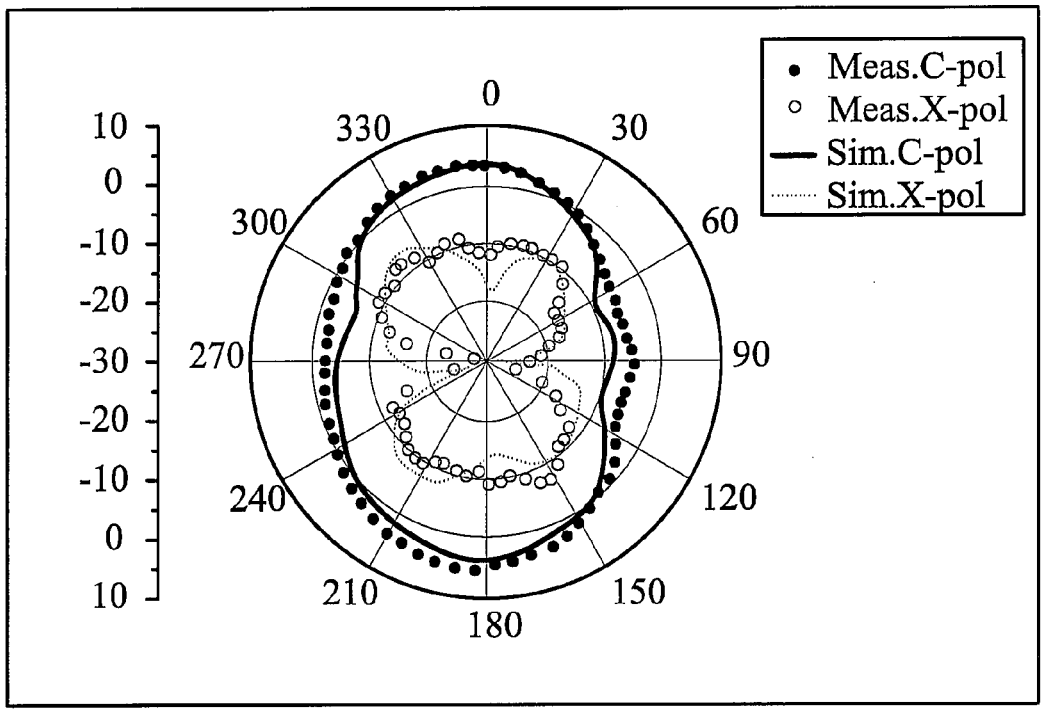
FIG. 6*a* shows divergence field on x-z plane of the first feed conductor of the invention.
Figure 6B:
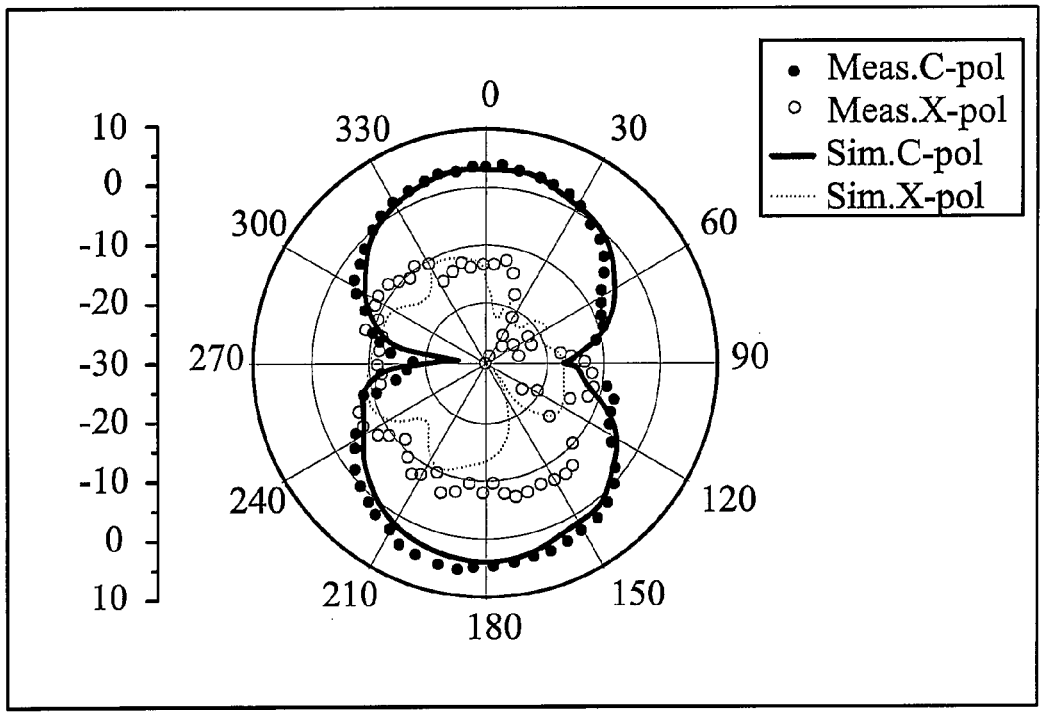
FIG. 6*b* shows divergence field on y-z plane of the first feed conductor of the invention.
Figure 7A:
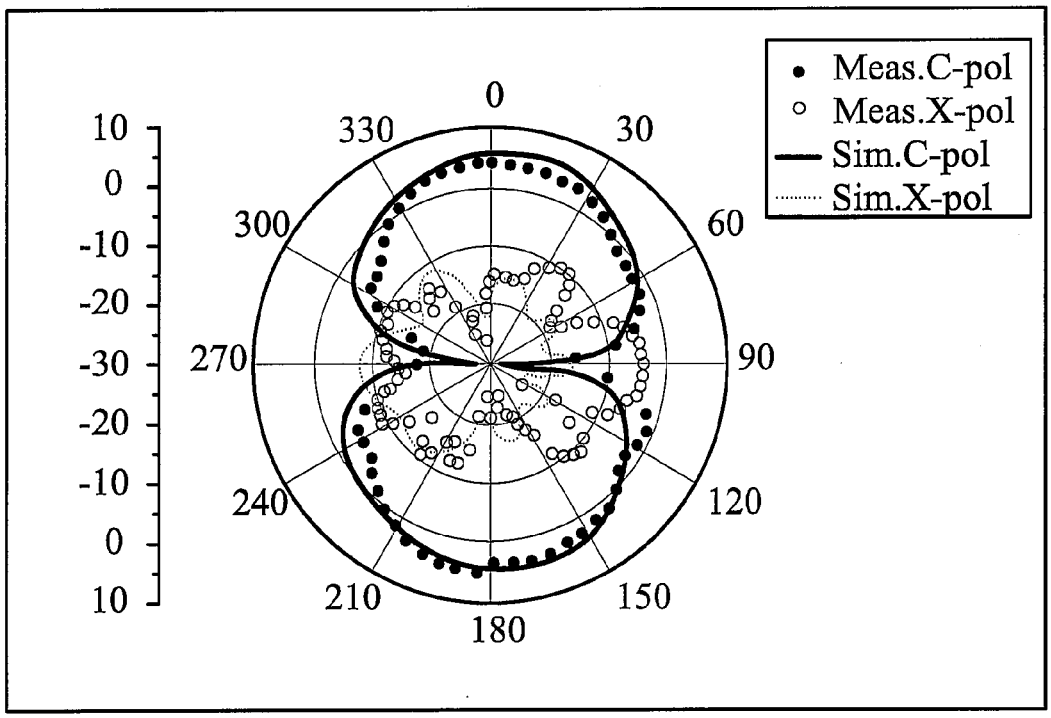
FIG. 7*a* shows divergence field on x-z plane of the second feed conductor of the invention.
Figure 7B:
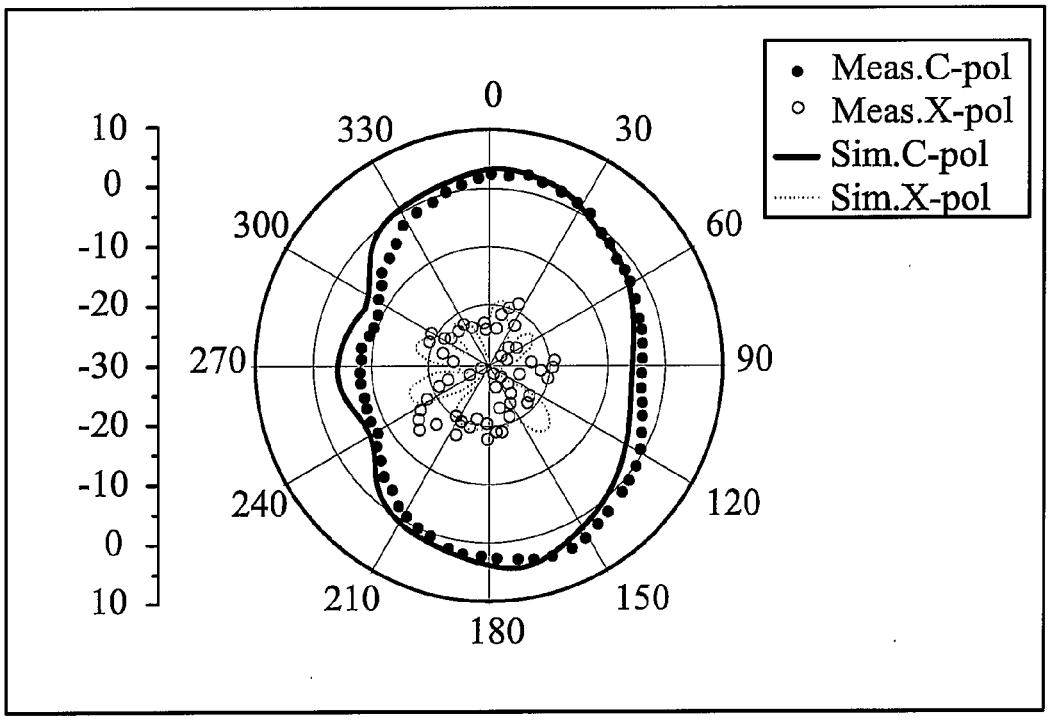
FIG. 7*b* shows divergence field on y-z plane of the second feed conductor of the invention.

FIG. 6*a* shows divergence field on x-z plane of the first feed conductor 130 (e.g. FIG. 2) of the invention, FIG. 6*b* shows divergence field on y-z plane of the first feed conductor 130 (e.g. FIG. 2) of the invention, FIG. 7*a* shows divergence field on x-z plane of the second feed conductor 140 (e.g. FIG. 2) of the invention, and FIG. 7*b* shows divergence field on y-z plane of the second feed conductor 140 (e.g. FIG. 2) of the invention. As shown in FIGS. 6*a*, 6*b*, 7*a* and 7*b*, the coupling device 100 of the invention also provides improved polarization isolation. In FIGS. 6*a*, 6*b*, 7*a* and 7*b*, "Meas. C-pol" means "Measured co-polarized", "Meas. X-pol" means "Measured cross-polarized", "Sim. C-pol" means "Simulated co-polarized", and "Sim. X-pol" means "Simulated cross-polarized".

In the embodiment of the invention, the shape and location of the first feed conductor 130 (e.g. FIG. 2) and the second feed conductor 140 (e.g. FIG. 2) can be modified according to matching requirement.

The coupling device of the invention can be a feed assembly mechanism of a dual-polarized antenna or an orthomode transducer of a wave guide.

While the invention has been described by way of example and in terms of preferred embodiment, it is to be understood that the invention is not limited thereto. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A coupling device, comprising:

a substrate, comprising a first surface and a second surface;

a ground element, disposed on the second surface, wherein the ground element comprises a first portion, a second portion, an annular groove and a feed slot, the annular groove is located between the first portion and the second portion, enclosing the first portion, and a first end of the feed slot is connected to the annular groove;

a first feed conductor, disposed on the first surface corresponding to the annular groove, wherein the first feed conductor couples the ground element to feed a current signal; and a second feed conductor, disposed on the first surface corresponding to the feed slot, wherein second feed conductor couples the feed slot to feed a magnetic current, wherein the substrate further comprises a first side and a second side, the first side is perpendicular to the second side, the first feed conductor extends in a first direction from the first side, the second feed conductor extends in a second direction from the second side, and the first direction is perpendicular to the second direction, wherein the first feed conductor comprises a first conductive portion and a first feed portion, the first feed portion corresponds to the annular groove, and the first conductive portion extends in the first direction from the first side connected to the first feed portion.

2. The coupling device as claimed in claim 1, wherein the coupling device is a feed assembly mechanism of a dual-polarized antenna.

3. The coupling device as claimed in claim 1, wherein the first feed conductor transmits a first wireless signal, the second feed conductor transmits a second wireless signal, and a polarization direction of the first wireless signal is perpendicular to a polarization direction of the second wireless signal.

4. The coupling device as claimed in claim 1, wherein the first feed conductor is T-shaped, and the first conductive portion is perpendicular to the first feed portion.

5. The coupling device as claimed in claim 1, wherein the ground element further comprises a short circuit slot connecting a second end of the feed slot.

6. The coupling device as claimed in claim 5, wherein the short circuit slot is circular.

7. The coupling device as claimed in claim 1, wherein the second feed conductor comprises a second conductive portion and a second feed portion, the second feed portion corresponds to the feed slot, and the second conductive portion extends in the second direction from the second side connected to the second feed portion.

8. The coupling device as claimed in claim 7, wherein the second feed portion is substantially sector-shaped, and comprises a convergent end connected to the second conductive portion.

9. The coupling device as claimed in claim 8, wherein the ground element further comprises a short slot connecting a second end of the feed slot, and the convergent end corresponds to the second end of the feed slot.

10. The coupling device as claimed in claim 7, wherein the second feed conductor further comprises a matching element connected to the second conductive portion and is perpendicular thereto.

11. The coupling device as claimed in claim 1, wherein the first portion is rectangular in shape.

12. The coupling device as claimed in claim 1, wherein the annular groove defines a rectangular area.

13. A coupling device, comprising:

a substrate, comprising a first surface and a second surface;

a ground element, disposed on the second surface, wherein the ground element comprises a first portion, a second portion, an annular groove and a feed slot, the annular groove is located between the first portion and the second portion, enclosing the first portion, and a first end of the feed slot is connected to the annular groove;

a first feed conductor, disposed on the first surface corresponding to the annular groove, wherein the first feed conductor couples the ground element to feed a current signal; and a second feed conductor, disposed on the first surface corresponding to the feed slot, wherein second feed conductor couples the feed slot to feed a magnetic current, wherein the substrate further comprises a first side and a second side, the first side is perpendicular to the second side, the first feed conductor extends in a first direction from the first side, the second feed conductor extends in a second direction from the second side, and the first direction is perpendicular to the second direction, wherein the second feed conductor comprises a second conductive portion and a second feed portion, the second feed portion corresponds to the feed slot, and the second conductive portion extends in the second direction from the second side connected to the second feed portion.

* * * * *